United States Patent [19]

Sonneville

[11] Patent Number: 4,566,629

[45] Date of Patent: Jan. 28, 1986

[54] STRUCTURE FOR FIXING A RAIL TO A TIE

[75] Inventor: Roger P. Sonneville, Annapolis, Md.

[73] Assignee: Sonneville International Corporation, Washington, D.C.

[21] Appl. No.: 534,623

[22] Filed: Sep. 22, 1983

[30] Foreign Application Priority Data

Mar. 2, 1983 [FR] France ..... 83 03426

[51] Int. Cl.[4] ..... E01B 9/28; E01B 3/28

[52] U.S. Cl. ..... 238/117; 238/89; 238/115; 238/265; 238/338

[58] Field of Search ..... 238/85, 87, 88, 91, 238/115, 117, 264, 265, 310, 338, 349, 84, 89

[56] References Cited

U.S. PATENT DOCUMENTS 982,315 1/1911 Tunis ..... 238/115
1,017,028 2/1912 Wilhelmi ..... 238/265 X
1,376,580 5/1921 Rapelje ..... 238/265
2,656,115 10/1953 Sonneville ..... 238/117

FOREIGN PATENT DOCUMENTS 0477163 9/1915 France ..... 238/91

*Primary Examiner*—Robert B. Reeves
*Assistant Examiner*—Dennis C. Rodgers
*Attorney, Agent, or Firm*—Wenderoth, Lind & Ponack

[57] ABSTRACT

A structure for fixing a rail to a tie includes a short stud 24 which is embedded in the concrete 2 of a tie above the longitudinally extending metal strut 4 of the tie and on the axis thereof. Welded to this stud, and even half embedded therein, are upper portions of two arch elements 26 whose branch are divergent on each side of the strut and are bent at their ends in the vicinity of the horizontal central axis of the strut so as to constitute hooks 34.

12 Claims, 2 Drawing Figures

STRUCTURE FOR FIXING A RAIL TO A TIE

BACKGROUND OF THE INVENTION

The present invention relates to a structure for fixing a rail to a concrete tie and more particularly adapted to the fixing of the rail to a tie of the "composite" type, ie. formed by two blocks of reinforced concrete interconnected by a steel strut or girder which extends at each end axially into the concrete block.

In ties of this type, the strut is placed on the longitudinal axis of the concrete blocks perpendicular to the axis of the rail and requires disposing the conventional fixing bolts or coach-screws on each side of the axis of symmetry of the tie or providing apertures in the strut for the passage of tightening means. Now, experience has shown that fasteners thus offset result in an increased fatigue of the fasteners of the rail and possibly of the elastically yieldable sole placed under the latter, when the rail deflects and oscillates on the tie upon the passage of wheels thereover.

Further, the apertures formed in the strut weaken the tie and in particular reduce its strength as concerns dynamic shear. The same is true of the vertical and lateral passages formed in the concrete which are essential in systems employing bolts having a hammer head.

SUMMARY OF THE INVENTION

An object of the present invention is consequently to overcome these drawbacks, ie. to permit the construction of a structure which is capable of being placed on the axis of the tie above the strut without requiring vertical or lateral passages.

The invention therefore provides a structure which comprises, in the extension of an outer screwthreaded stem, a short lower end embedded in the concrete above the strut of the tie and in alignment with the axis of symmetry of the tie, there being four rods which extend from said lower end in a divergent manner on each side of the strut to the vicinity of the neutral axis of the strut.

According to a preferred embodiment, the rods are branches of two divergent arch elements whose upper portions are welded to the lower end at diametrically opposed points.

The arch elements are preferably both welded and semi-inserted by a forging operation on the base of the structure, the two electrodes of a resistance welding machine employing pulses placed on each side of the upper portions of these arch elements exerting on the latter a pressure perpendicular to the axis of the structure.

The connection between the lower end and the arch elements is thus extremely strong, notwithstanding the fact that said lower end is very short. Further, the arch elements surround a block of concrete which is substantially trapezoidal in shape and have extending therethrough the strut and thus ensure a solid fixing of the structure in the concrete so that the structure exerts a considerable resistance to being torn away.

BRIEF DESCRIPTION OF THE DRAWINGS

The following description of one embodiment, which is given merely by way of example and shown in the accompanying drawings, will bring out the advantages and features of the invention.

In the drawings.

DETAILED DESCRIPTION OF THE INVENTION

Figure 1:
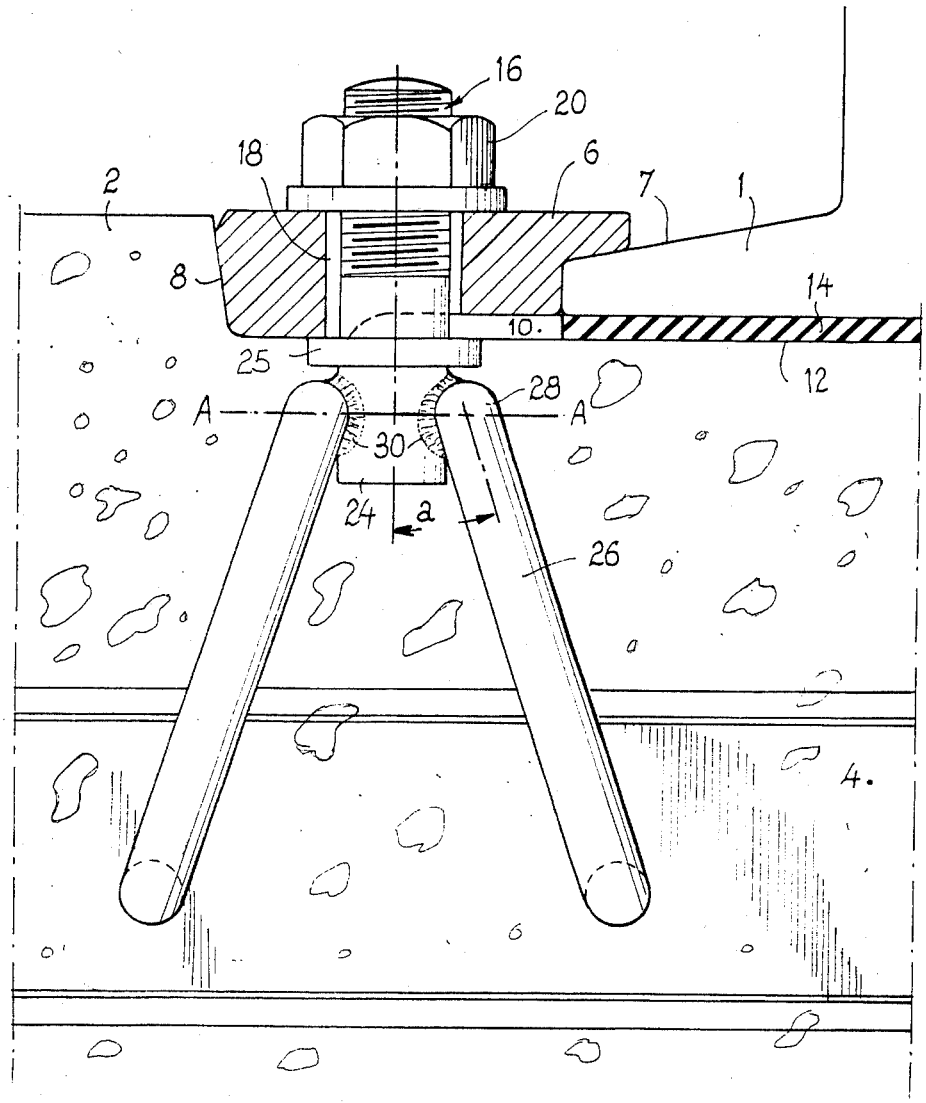
FIG. 1 is a view, partly in section in a plane perpendicular to the longitudinal axis of the rail, of a rail fixing device.

The structure according to the invention is intended for fixing a rail 1 to the concrete of a tie, or more precisely to one of the blocks of reinforced concrete 2 of a compostie tie, ie. a tie comprising two reinforced concrete blocks interconnected by a steel strut 4 which extends longitudinally at each end into each of the two blocks and on the axis of the latter.

The fixing device generally comprises a clip 6 which bears, at one end, against the flange 7 of the rail 1 and, at its other end, against the concrete 2 and against a lateral shoulder 8.

In the illustrated embodiment, the shoulder 8 is the edge of a cavity 10 formed in the block 2 for supporting the rail 1 which bears against the bottom 12 of this cavity, preferably with interposition of a sole 14 of steel or resiliently yieldable material.

The clip 6 is held in position by a fixing structure 16 which extends through an axial aperture 18 in this clip and on which is screwed a nut 20.

According to the invention, the fixing structure comprises a substantially vertical screwthreaded stem 22 which includes a lower end and is extended in its lower part by a substantially cylindrical non-screwthreaded stud 24 which is embedded in the concrete of the block 2 above the strut 4 but is in alignment with the axis of this strut. Preferably, the structure 16 has a flange 25 at the junction between the stud 24 and the screwthreaded stem 22 so as to facilitate the manufacture of the screws of stem 22 and enable the structure 16 to be held stationary at a correct level when it is mounted in a mould before the pouring of the concrete to form the blocks. The upper surface of the flange is indeed placed in the plane of the surface 12 of the block 2, ie. at the bottom of the cavity 10.

The stud 24 is moreover rigid with two arch elements 26 which are fixed thereto in their upper part and extend inside the concrete on each side of the strut 4 in diverging from each other. The upper parts 28 of the arch elements 26 are welded to the stud 24 in two diametrically opposed regions 30 centered on a common horizontal axis A. They are preferably welded by an electric resistance welding with the use of successive pulses of less than one second, by means of a machine whose two electrodes exert pressures in opposite directions on the two upper parts 28 along the horizontal axis A.

Under the effect of this pressure and the successive pulses which ensure a deep heating, the stud and the two upper parts are subjected to a forging effect and penetrate into each other. The upper parts 28 are thus partly inserted in the diametrically opposed regions 30 of the stud and this has for effect to increase the strength of the weld, in particular as concerns upward tensile forces exerted when tightening the nut 20.

These arch elements 26, which diverge downwardly, also have branches 32 which diverge so that each one has substantially the shape of an inverted V. The branches 32 diverge progressively a sufficient distance to avoid coming into mechanical contact with the strut 4 and to avoid any undesirable electric conductivity therebetween and with the strut. The length of the branches 32 is such that they approach the horizontal central axis of the strut 4 and even preferably extend slighty below this axis.

Figure 2:
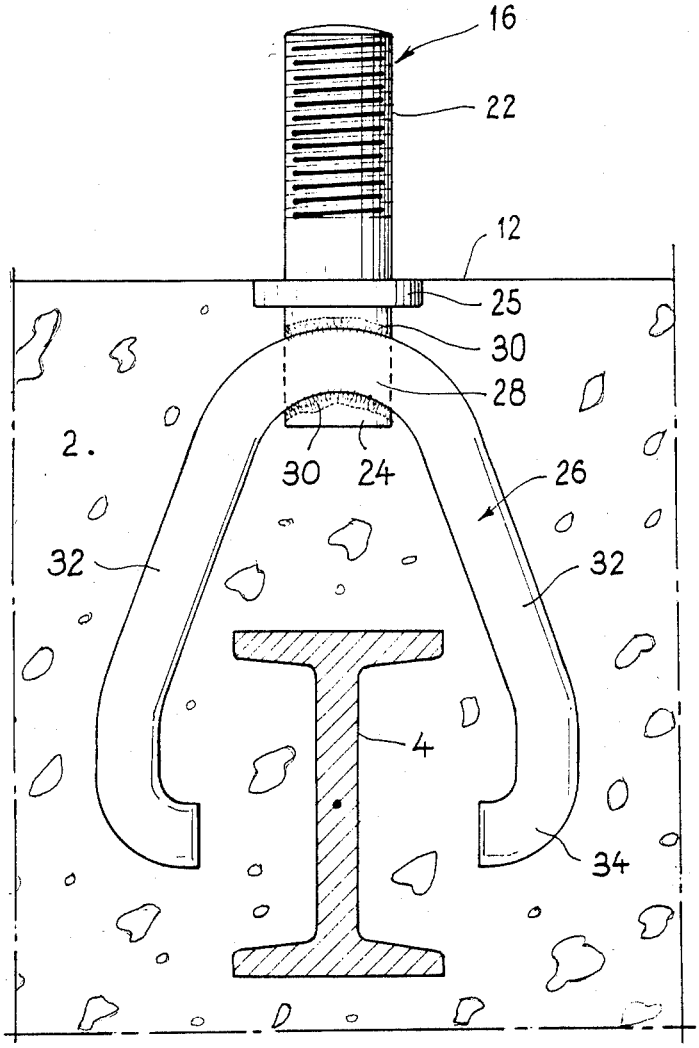
FIG. 2 is a partial sectional view in a plane perpendicular to the concrete tie showing the structure before the mounting of the fixing device.

As shown in FIG. 2, the ends 34 of the branches 32 are preferably curved so as to form hooking hooks which complete and reinforce the hooking of the branches 32 due to the simple adherence of the concrete in which they are embedded.

In the preferred embodiment shown in FIG. 2, the hooks 34 are bent in the direction toward the strut 4, but they could of course be oriented in any other direction, depending on the desired resistance to extraction.

It will be understood that the distance between the ends 34 of the branches 32 of the arch elements is in any case greater than the width of the upper end of the strut 4 so as to enable the latter to be placed in position in the mould for pouring and moulding the concrete.

The inclination of the branches 32 of each arch element and the inclination of the two arch elements 26 relative to each other, are so chosen as to define within the block a large volume of concrete of pyramidal shape which disperses the tensile stresses by transmitting them partly to the strut 4. In this way, structure 16 is firmly fixed in the concrete 2 and is capable of effectively resisting the forces exerted by the rail.

Further, the structure is easy to construct by a simple simultaneous operation for welding the two arch elements which is extremely rapid and easy to automatize and which, moreover, imparts to the structure a very high strength. Tests carried out in the laboratory have indeed shown that the resistance to extraction of prototype fixing bolts having a diameter of 22 mm and roots of 12 mm exceeded 10 metric tons notwithstanding the fact that the length of the smooth stud embedded in the concrete did not exceed 30 mm.

Further, this structures can be easily fixed by its screwthreaded stem in the bottom of a moulding mould so that its presence does not complicate the manufacture of the tie, which renders it both easy and inexpensive to make.

Having now described my invention what I claim as new and desire to secure by Letters Patent is:

1. A structure for use in fixing a rail to a tie, and in particular a composite tie comprising two concrete blocks interconnected by a steel strut, which strut is axially extended into each of the blocks, said structure comprising a screwthreaded member having a lower end which is intended to be embedded in the respective concrete block above said strut and in alignment with the axis of symmetry of the strut, four rods extending in a divergent manner from said lower end for assuming positions on each side of the strut and having such lengths as to terminate in the vicinity of the level of the neutral axis of the strut, said rods comprising branches of two divergent arch elements having upper portions welded to diametrically opposed parts of said lower end of said member.

2. A structure according to claim 1, wherein said upper portions of said arch elements are both welded and substantially half embedded in said lower end of said member by a forging effect of two electrodes of a resistance welding machine operating by pulses, the electrodes being placed on each side of said upper portions and exerting thereon pressures in opposite directions perpendicular to the axis of said member.

3. A structure according to claim 1, wherein said arch elements are inclined and diverge from each other from said lower end.

4. A structure according to claim 2, wherein said branches of each of said two arch elements diverge from each other in positions for location on each side of the strut by a distance which is sufficient to avoid any mechanical contact and any electrical conductivity with the strut.

5. A structure according to claim 4, wherein said arch elements are inclined and diverge from each other from said lower end.

6. A structure according to claim 1, wherein said branches of each of said two arch elements diverge from each other in positions for location on each side of the strut by a distance which is sufficient to avoid any mechanical contact and any electrical conductivity with the strut.

7. A structure according to claim 6, wherein said arch elements are inclined and diverge from each other from said lower end.

8. A structure according to claim 1, wherein said arch elements are inclined and diverge from each other from said lower end.

9. A structure according to claim 1, wherein said rods are bent at their ends so as to constitute hooks at a level in the vicinity of the horizontal neutral axis of the strut.

10. A structure according to claim 9, wherein said hooks extend toward the strut.

11. A structure according to claim 1, wherein said screwthreaded member comprises a stem having external threads.

12. A structure according to claim 11, further comprising a clip having therethrough an aperture, said stem extending through said aperture, said clip having opposite ends adapted to bear respectively on the rail and on the tie, and a nut threaded onto said stem and operating against said clip.

* * * * *